US010874182B2

(12) United States Patent
Ma

(10) Patent No.: US 10,874,182 B2
(45) Date of Patent: Dec. 29, 2020

(54) UMBRELLA RIB CONNECTOR ASSEMBLIES AND METHODS

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 0 days.

(21) Appl. No.: 16/416,615

(22) Filed: May 20, 2019

(65) Prior Publication Data

US 2019/0373992 A1 Dec. 12, 2019

Related U.S. Application Data

(63) Continuation of application No. 15/792,233, filed on Oct. 24, 2017, now Pat. No. 10,292,466.

(60) Provisional application No. 62/412,435, filed on Oct. 25, 2016.

(51) Int. Cl.

| | |
|---|---|
| ***A45B 25/02*** | (2006.01) |
| ***A45B 25/10*** | (2006.01) |
| ***A45B 25/08*** | (2006.01) |

(52) U.S. Cl.

CPC ..... *A45B 25/02* (2013.01); *A45B 25/08* (2013.01); *A45B 25/10* (2013.01)

(58) Field of Classification Search

CPC ..... E04H 15/18; E04H 15/28; E04H 15/26; E04H 15/58; A45B 25/02; A45B 25/06; A45B 25/10; A45B 25/08

USPC ..... 135/135, 147, 28–32; 403/217–219

See application file for complete search history.

(56) References Cited

U.S. PATENT DOCUMENTS

| | | | |
|---|---|---|---|
| 331,231 | A | 11/1885 | Folger |
| 476,364 | A | 6/1892 | Collins |
| 501,089 | A | 7/1893 | Lichtenstein |
| 620,815 | A | 3/1899 | Warren |
| 750,178 | A | 1/1904 | Fesenfeld |
| 770,704 | A | 9/1904 | Vogel |
| 847,805 | A | 3/1907 | McAvoy |
| 899,718 | A | 9/1907 | Eberle |
| 878,270 | A | 2/1908 | Blake et al. |

(Continued)

FOREIGN PATENT DOCUMENTS

| | | |
|---|---|---|
| CA | 1269018 | 5/1990 |
| CN | 204444542 | 7/2015 |

(Continued)

OTHER PUBLICATIONS

EPO Extended Search Report dated Apr. 5, 2011 for European Patent No. 09252140.0, filed Sep. 7, 2009.

(Continued)

*Primary Examiner* — Noah Chandler Hawk

(74) *Attorney, Agent, or Firm* — Knobbe Martens Olson & Bear LLP

(57) ABSTRACT

In one aspect of the present disclosure, an umbrella hub assembly comprises an a cylindrical portion and a socket coupled to the cylindrical portion. The socket can have a fixed end, a free end, and a cylindrical wall defining a concave space extending from the free end toward the fixed end. The socket can have an access aperture disposed through the cylindrical wall. The assembly can further include an umbrella rib comprising a first end, a second end, and an elongate body extending along a longitudinal axis. The first end can be configured to be received in the concave space through the free end such that the socket engages the umbrella rib and such that the first end is accessible through the access aperture.

18 Claims, 8 Drawing Sheets

(56) References Cited

U.S. PATENT DOCUMENTS 880,534 A 3/1908 Hoyt
897,026 A 8/1908 Seitzinger
924,627 A 6/1909 Baker et al.
928,169 A 7/1909 Bardon
941,952 A 11/1909 Riehl
947,790 A 2/1910 Carter
959,127 A 5/1910 Edwards
1,001,076 A 8/1911 Redford
1,022,944 A 4/1912 Hodinger
1,078,069 A 11/1913 Simons
1,107,415 A 8/1914 Drohan
1,264,075 A 4/1918 Hout
1,469,495 A 10/1923 Bunker
1,712,430 A 5/1929 Giszczynski
1,808,610 A 6/1931 Roy
1,852,513 A 4/1932 Frey
1,862,674 A 6/1932 Frey
2,101,510 A 12/1937 Rathbun
2,207,043 A 7/1940 Weiss et al.
2,321,495 A 6/1943 Levin
2,336,116 A 12/1943 Morando
2,385,575 A 9/1945 Isler
2,469,637 A 5/1949 Evans et al.
2,635,616 A 4/1953 Haydu
2,762,383 A 9/1956 Wittman
2,796,073 A 6/1957 Wittman
2,860,647 A 11/1958 Negri
2,914,154 A 11/1959 Russell
3,157,186 A 11/1964 Hammer
3,177,882 A 4/1965 Vincent
3,181,542 A 5/1965 Bareis
3,252,468 A 5/1966 Militano
3,330,582 A 7/1967 Morris
3,424,180 A 1/1969 Andolfi
3,462,179 A 8/1969 Hinkle
3,557,809 A 1/1971 Vazquez et al.
3,643,673 A 2/1972 Weber
3,704,479 A 12/1972 Whitaker
D231,955 S 6/1974 Weber
4,201,237 A 5/1980 Watts et al.
4,368,749 A 1/1983 Lindler et al.
4,369,000 A 1/1983 Egnew
4,627,210 A 12/1986 Beaulieu
4,673,308 A 6/1987 Reilly
4,750,509 A 6/1988 Kim
4,790,338 A 12/1988 Strobl
4,941,499 A 7/1990 Pelsue et al.
4,966,178 A 10/1990 Eichhorn
D320,111 S 9/1991 Ma
5,056,291 A 10/1991 Leung
D321,779 S 11/1991 Ma
5,069,572 A 12/1991 Niksic
5,085,239 A 2/1992 Chin-Hung et al.
5,188,137 A 2/1993 Simonelli
5,193,566 A 3/1993 Chen
5,328,286 A 7/1994 Lee
D360,522 S 7/1995 Ko
5,433,233 A 7/1995 Shiran et al.
5,445,471 A 8/1995 Wexler et al.
5,694,958 A 12/1997 Chang
5,738,129 A 4/1998 Vogt
5,740,824 A 4/1998 Tang
5,797,613 A 8/1998 Busby
5,797,695 A 8/1998 Prusmack
5,842,494 A 12/1998 Wu
D411,655 S 6/1999 Tung
5,911,233 A 6/1999 Wu
D412,056 S 7/1999 Wang
6,076,540 A 6/2000 You
6,095,169 A 8/2000 Lin et al.
6,116,256 A 9/2000 Pawsey et al.
6,199,572 B1 3/2001 Rousselle et al.
6,227,753 B1 5/2001 Boer
6,298,867 B1 10/2001 Chang
6,311,706 B1 11/2001 Sato
6,314,976 B1 11/2001 Clarke
6,332,657 B1 12/2001 Fischer
6,345,637 B1 2/2002 Ko
6,354,316 B1 3/2002 Chen
6,374,840 B1 4/2002 Ma
6,386,215 B1 5/2002 Chang
6,397,867 B2 6/2002 You
D460,947 S 7/2002 Montena
D465,915 S 11/2002 Earnshaw
6,499,856 B2 12/2002 Lee
6,604,844 B2 8/2003 Hussey
6,643,889 B1 11/2003 Kotlarski
6,651,682 B1 11/2003 Woodward
6,701,946 B2 3/2004 You
6,705,335 B2 3/2004 You
6,732,753 B2 5/2004 Chang
6,758,228 B1 7/2004 You
6,758,354 B2 7/2004 Carletti
6,769,441 B2 8/2004 Liu
6,814,093 B2 11/2004 You
6,904,923 B2 6/2005 Chai et al.
7,178,535 B2 2/2007 Eder
7,464,503 B2 12/2008 Hoberman
7,481,235 B2 1/2009 Prusmack
7,509,967 B2 3/2009 Kim
7,574,777 B1 8/2009 Fuller et al.
7,637,276 B2 12/2009 Mallookis et al.
7,686,024 B1 3/2010 Lai
7,703,464 B2 4/2010 Ma
D623,396 S 9/2010 He
D626,324 S 11/2010 Ma
7,861,734 B2 1/2011 Ma
D631,848 S 2/2011 Montena et al.
7,891,367 B2 2/2011 Ma
8,061,375 B2 11/2011 Ma
8,069,872 B2 12/2011 Bae
8,082,935 B2 12/2011 Ma
8,082,937 B2 12/2011 Tarter et al.
8,166,986 B2 5/2012 Ma
D661,659 S 6/2012 Natoli et al.
D662,064 S 6/2012 Natoli et al.
D668,446 S 10/2012 Patzak
D670,901 S 11/2012 Rothbucher et al.
8,356,613 B2 1/2013 Ma
8,360,085 B2 1/2013 Lee
8,485,208 B2 7/2013 Seo
8,496,019 B2 7/2013 Zhou
8,522,804 B1 9/2013 Tung
8,534,304 B1 9/2013 Tung
8,555,905 B2 10/2013 Ma
8,763,620 B1 7/2014 Tung
D719,342 S 12/2014 Ma
D719,343 S 12/2014 Ma
8,899,250 B1 12/2014 Tung
9,060,576 B2 6/2015 Siegenthaler
9,078,497 B2 7/2015 Ma
9,113,683 B2 8/2015 Ma
D738,609 S 9/2015 Ma
9,192,215 B2 11/2015 Ma
D744,742 S 12/2015 You
D749,835 S 2/2016 Whitaker
9,265,313 B1 * 2/2016 Ma ..... A45B 25/02
D750,364 S 3/2016 Lah
9,433,269 B2 9/2016 Ma
9,498,030 B2 11/2016 Ma
9,615,637 B1 4/2017 Tung
D786,661 S 5/2017 Wright
D813,525 S 3/2018 Ma
D814,173 S 4/2018 Ma
10,034,524 B2 7/2018 Ma
D826,543 S 8/2018 Ma
10,060,152 B2 8/2018 Ma
D833,137 S 11/2018 Ma
10,292,466 B2 5/2019 Ma
10,631,603 B2 4/2020 Ma
10,631,604 B2 4/2020 Ma
10,631,605 B2 4/2020 Ma
10,736,390 B2 8/2020 Ma
2001/0007260 A1 7/2001 Rousselle et al.

(56) References Cited

U.S. PATENT DOCUMENTS

| | | | |
|---|---|---|---|
| 2004/0025915 | A1 | 2/2004 | Wang |
| 2004/0123891 | A1 | 7/2004 | Ma |
| 2004/0255993 | A1 | 12/2004 | Ma |
| 2005/0115599 | A1 | 6/2005 | You |
| 2006/0005867 | A1 | 1/2006 | Chang |
| 2006/0024128 | A1 | 2/2006 | Chiu |
| 2006/0124160 | A1 | 6/2006 | Lee |
| 2007/0113878 | A1 | 5/2007 | Ko |
| 2007/0172310 | A1 | 7/2007 | Yang et al. |
| 2007/0261728 | A1 | 11/2007 | Lin et al. |
| 2009/0071518 | A1 | 3/2009 | Amsel |
| 2009/0126769 | A1 | 5/2009 | Hoogendoorn |
| 2009/0260664 | A1 | 10/2009 | Ma |
| 2010/0288318 | A1 | 11/2010 | Beaulieu |
| 2011/0017249 | A1 | 1/2011 | Ma |
| 2011/0132418 | A1 | 6/2011 | Ma |
| 2011/0209732 | A1 | 9/2011 | Ma |
| 2011/0214705 | A1 | 9/2011 | Ma |
| 2012/0318316 | A1 | 12/2012 | Choi et al. |
| 2013/0008478 | A1 | 1/2013 | Prieto |
| 2013/0206192 | A1 | 8/2013 | Ma et al. |
| 2014/0026931 | A1 | 1/2014 | Lee |
| 2014/0069476 | A1 | 3/2014 | Zimmer et al. |
| 2016/0115707 | A1 | 4/2016 | Schneider et al. |
| 2018/0153269 | A1 | 6/2018 | Ma |
| 2019/0045894 | A1 | 2/2019 | Ma |
| 2019/0119946 | A1 | 4/2019 | Ma |
| 2019/0191834 | A1 | 6/2019 | Ma |

FOREIGN PATENT DOCUMENTS

| | | |
|---|---|---|
| DE | 1152226 | 8/1963 |
| EP | 0202769 | 12/1989 |
| EP | 0897678 | 2/1999 |
| EP | 2 774 504 | 1/2017 |
| FR | 855628 | 5/1940 |
| FR | 002650491 | 2/1991 |
| FR | 2857835 | 1/2005 |
| GB | 2113543 | 8/1983 |
| GB | 2165448 | 11/1987 |
| JP | 61131921 | 8/1986 |
| JP | H08-322621 | 12/1996 |
| JP | 2002-336020 | 11/2002 |
| JP | 3144314 | 7/2008 |
| JP | 2009-045359 | 3/2009 |
| KR | 100851744 | 8/2008 |
| KR | 10-2009-0110808 | 10/2009 |
| KR | 10-2012-0107607 | 10/2012 |
| WO | WO 2005/023042 | 3/2005 |
| WO | WO 2017/048868 | 3/2017 |

OTHER PUBLICATIONS

Extended European Search Report issued in EP Application No. 14157685, dated Jul. 7, 2014, in 8 pages.

Extended European Search Report issued in EP Application No. 14158057, dated Jul. 7, 2014, in 7 pages.

Extended European Search Report issued in EP Application No. 15156587.6, dated Jul. 23, 2015, in 7 pages.

International Search Report and Written Opinion issued in PCT Application No. PCT/US2016/051771, dated Dec. 28, 2016.

Treasure Garden, 2010 Products Catalog, pp. 20 and 60.

* cited by examiner

UMBRELLA RIB CONNECTOR ASSEMBLIES AND METHODS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

This application relates to apparatuses and methods that facilitate efficient assembly of ribs and hubs of umbrellas and other structures with a plurality of elongate structural members that extend from a central hub member.

Description of the Related Art

Larger umbrellas, such as market umbrellas, generally include a frame that is used to support and distribute the weight of an upper portion of the umbrella as well as to enable the umbrella to be opened and closed as desired by the user. The frame can take various forms, but often includes one or more hubs connected with a plurality of structural members. The structural members can move relative to the hub(s) to facilitate opening and closing of the umbrella.

Prior art methods of assembly of umbrella hubs and ribs are labor intensive. For example, in one common process a pin is inserted through an end portion of each rib of a set of ribs. All of the rib ends are positioned in a lower portion of a hub. An upper portion of the hub then placed over the rib ends, which have been so positioned. Finally, screws are advanced through the upper and lower hub portions to attach the upper and lower portions to each other. While achieving the result of assembling the hub and ribs, this process is tedious and sometimes requires rework, for example if the ends of any of the ribs become misaligned before the upper and lower hub portion are attached to each other.

Additionally, prior art umbrella hubs assembled with ribs are not designed in a way that the ribs are easily replaceable if broken. To replace a broken rib in some prior art umbrella hubs, the entire umbrella hub assembly must be disassembled to remove the broken umbrella rib or portions thereof, a new umbrella rib placed into the hub, and the hub reassembled. In other prior umbrella hubs, the ribs maybe inserted into an umbrella hub but no way is provided for the umbrella rib to be removed from the umbrella hub and removal requires structural damage to the umbrella hub, making the hub unusable.

SUMMARY OF THE INVENTION

An aspect of at least one embodiment disclosed herein is the realization that prior art umbrella hubs or hub assemblies provide no convenient means for removing or replacing broken ribs. For example, the entire assembly must be entirely or partially disassembled and reassembled or the umbrella hub may be structurally damaged to remove a broken rib. In a one-piece hub there may be no practical way to replace a broken rib. Therefore, embodiments disclosed herein seek to remedy this deficiency by providing a hub assembly that can enable broken ribs to be removed and replaced with new ribs. Accordingly, it would also be beneficial to provide structures in an umbrella hub that enable broken ribs to be removed and replaced with new ribs to reduce replacement labor and cost and to protect structural integrity of the umbrella hub.

Another aspect of at least one embodiment disclosed herein is the realization that the structures of umbrella rib ends that are coupled with the umbrella hub can be greatly simplified. For example, prior art umbrella rib ends use individual pins that are each pivotably coupled within the umbrella hubs. These individual pins also provide the securement mechanism to connect the umbrella ribs to the umbrella hub. This tedious manufacturing process can be costly and frustrating. Accordingly, it would also be beneficial to provide structures in an umbrella hub and rib ends that enable the umbrella ribs to be securely coupled with the umbrella hubs but that do not require or lessen the reliance on individual pins in such coupling.

In one aspect of the present disclosure, an umbrella assembly comprises an elongate pole having an upper end, a lower end and a longitudinal axis extending therebetween. The umbrella assembly further comprises an umbrella hub coupled with the umbrella pole. Optionally, the umbrella hub includes a cylindrical portion disposed about the elongate pole and a socket coupled to the cylindrical portion. The socket can have a fixed end, a free end disposed away from the fixed end, and a cylindrical wall disposed between the fixed end and the free end. The cylindrical wall can define a concave space extending from the free end toward the fixed end. The socket can have an access aperture disposed through the cylindrical wall. The assembly can have an umbrella rib comprising a first end, a second end, and an elongate body extending along a longitudinal axis disposed between the first end and the second end. The first ends of the umbrella ribs can have a segment that is wider in a direction transverse to the longitudinal axis than an adjacent segment. The adjacent segment is disposed between the widened segment and the second end of the umbrella rib. The first end can be configured to be received in the socket through the free end. The socket can engage the adjacent segment such that the widened segment is accessible through the access aperture. The access aperture can be disposed through the sidewall or the access apertures can extend partway through the cylindrical wall.

In another aspect of the disclosure, a method of replacing an umbrella rib comprises providing an umbrella assembly. The umbrella assembly can comprise an umbrella rib coupler having an arcuate portion disposed along a channel having a channel axis and a socket coupled to the arcuate portion. The socket can have a fixed end, a free end disposed away from the fixed end, and a cylindrical wall disposed between the fixed end and the free end. The cylindrical wall can define a concave space extending from the free end toward the fixed end, the socket having an aperture disposed through the cylindrical wall. The umbrella assembly can further comprise an umbrella rib having a first end, a second end, and an elongate body extending along a longitudinal axis disposed between the first end and the second end. The first end of the umbrella ribs optionally is configured to be disposed in the socket. Optionally, the method of replacing an umbrella rib further comprises accessing the first end through the aperture, severing the first end of the umbrella rib from the elongate body, ejecting a severed end of the umbrella rib from the socket through the aperture, and removing the elongate body from the concave space through the free end of the socket. Optionally, the method further comprises inserting another umbrella rib into the socket.

In another aspect of the disclosure, an umbrella assembly can comprise an umbrella rib coupler having an arcuate portion disposed along a channel. The channel has a channel axis. A socket can be coupled to the arcuate portion. The socket can have a fixed end, a free end disposed away from the fixed end, and a cylindrical wall disposed between the fixed end and the free end. The cylindrical wall can define a concave space extending between the free end and the fixed end. The socket can have an access aperture disposed through the cylindrical wall. An umbrella rib can comprise an enlarged first end, a second end, and an elongate body. The elongate body can extend from the enlarged first end toward the second end along a longitudinal axis disposed between the first end and the second end. Optionally, at least a portion of the elongate body can be adjacent to the first end and can be narrower than the enlarged first end. The first end of the umbrella ribs can optionally be configured to be received in the socket through the free end and optionally to be accessible through the access aperture disposed through the cylinder wall when so received.

In another aspect of any of the above disclosures, the elongate body of the umbrella rib can comprise a flat portion adjacent to the first end.

In another aspect of the disclosure, the access aperture disposed through the cylindrical wall can be a first access aperture, the assembly further comprising a second access aperture disposed through the cylindrical wall.

In another aspect of any of the above disclosures, the concave space defined in the socket can have a narrow region located between the free end and the fixed end, the narrow region defined on at least one side by a deflectable member. The deflectable member can optionally be deflectable away from a center of the concave space. For example, the deflectable member can be deflected by advancement of the umbrella rib into the free end and toward the fixed end and to return toward the center of the concave space upon further advancement of the umbrella rib into the socket.

In another aspect of any of the above disclosures, the socket and the cylindrical portion can comprise a continuous expanse of material (e.g., are formed integrally, such as by injection molding).

In another aspect of any of the above disclosures, a pivotal connection can be provided by a locally thin expanse disposed between the fixed end of the socket and the cylindrical portion.

In another aspect of any of the above disclosures, a flexible region can be disposed between the socket and the cylindrical portion of the umbrella hub.

In another aspect of any of the above disclosures, the umbrella hub can be fixedly attached to the upper end of the elongate pole.

In another aspect of any of the above disclosures, the umbrella hub can be slideably coupled along a length of the elongate pole between the upper end and the lower end thereof.

In another aspect of any of the above disclosures, the concave space defined in the socket can have a narrow region comprising a transverse width that is narrower than a transverse width of the first end of the umbrella rib. The concave space can comprise an elastic material whereby the narrow region may be enlarged to permit the first end of the umbrella rib to be advanced therethrough.

In another aspect of any of the above disclosures, the arcuate portion can comprise a continuous circumference.

In another aspect of any of the above disclosures, the umbrella rib can be a first umbrella rib and the assembly further comprises a second umbrella rib. The second umbrella rib can comprise opposite ends and a central portion, the central portion of the second umbrella rib coupled with the arcuate portion of the umbrella rib coupler.

In another aspect of any of the above disclosures, the arcuate portion can be disposed around an umbrella pole and the umbrella rib coupler comprises a top notch or a runner.

In another aspect of the method described above, the method can further comprise removing the first end of the umbrella rib from the concave space through the cylindrical wall by passing the first end through the aperture.

In another aspect of the method described above, the method can further comprise wherein the elongate body comprises a reduced width segment disposed adjacent to the first end, the reduced width segment being disposed in the socket.

In another aspect of the method described above, the method can further comprise wherein the first end of the umbrella rib is separated from elongate body at the reduced width segment.

In another aspect of the method described above, the method can further comprise wherein the umbrella rib is broken.

In another aspect, an umbrella assembly includes an elongate pole and an umbrella hub coupled with the elongate pole. The umbrella hub includes a cylindrical portion and a plurality of sockets. A socket of the plurality of sockets has a fixed end coupled with, e.g., integrally formed with, the cylindrical portion. A free end of the socket extends away from the cylindrical portion. A space within the socket can be accessible through an opening on the free end of the socket. The space includes a narrow region and a widened region. The narrow region can be located between the free end and the widened region. The umbrella assembly also includes an umbrella rib comprising an inner end, an outer end, and an elongate body extending along a longitudinal axis of the umbrella rib and disposed between the inner end and the outer end. The inner end of the umbrella ribs has a widened segment that can be wider in a direction transverse to the longitudinal axis of the umbrella rib than an adjacent segment. The adjacent segment can be disposed between the widened segment and the second end of the umbrella rib. The inner end can be configured to be received within the space through the opening and advanced through the narrow region to the widened region. A catch surface of the socket prevents the widened segment from being removed from the widened region back through the narrow region.

In another aspect, a method of assembling an umbrella rib includes inserting an inner end of an umbrella rib into a concave space through an opening at a free end of a socket. The socket can be coupled with, e.g., integrally formed with, a central hub. The method includes advancing the inner end through a narrow region of the concave space and elastically deforming or otherwise at least temporarily displacing a catch surface of the socket. The catch surface can be located between the narrow space and a widened region of the concave space. The method can include advancing the inner end out of the narrow region and into the widened region and blocking the return of the inner end of the umbrella rib back through the narrow region of the socket by the catch surface. The catch surface can at least partially return to an original position after having been elastically deformed and after the inner end can be advanced out of the narrow region.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No aspects of this disclosure are essential or indispensable.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

DETAILED DESCRIPTION OF THE PREFERRED EMBODIMENT

Figure 1:
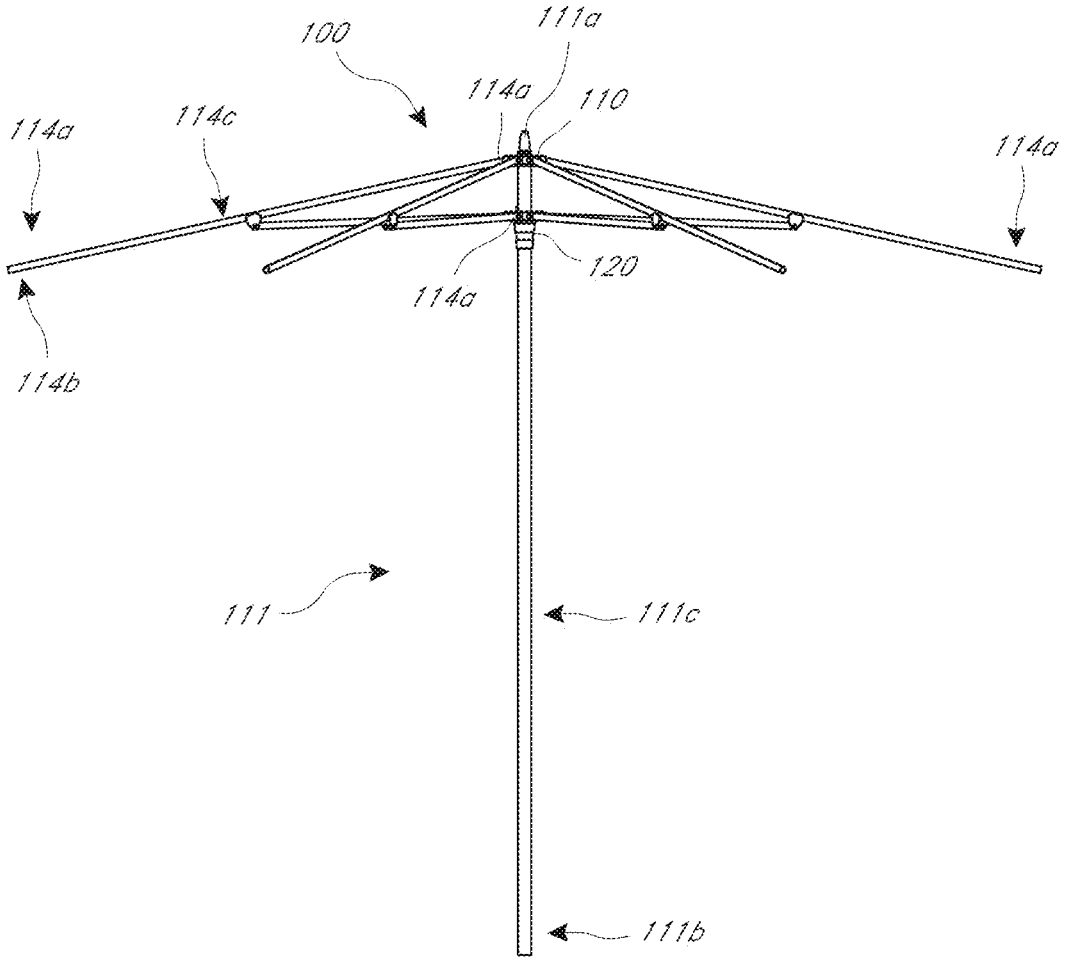
FIG. 1 is a side elevation view of an umbrella assembly including upper and lower hubs disposed about an umbrella pole and a plurality of elongate ribs and struts extending therefrom, according to one embodiment.

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No aspects of this disclosure are essential or indispensable.

In accordance with embodiments described herein, there are provided various configurations of a hub and hub assembly that can be used with an umbrella assembly, including an umbrella support structure, an umbrella or pavilion, to facilitate the rapid and secure fastening of structural ribs with a hub or other structure. There are also provided various configurations of a hub and hub assembly that can be used to remove a rib after the rib has assembled with the hub and a new rib assembled with the hub.

FIG. 1 illustrates an embodiment of an umbrella assembly 100 that includes a lower hub 120 and an upper hub 110 assembled with a plurality of elongate ribs 114 on an elongate pole 111. The hubs 110, 120 can be configured for excellent manufacturability and also for efficient use of components, such as reducing the number of components, and increasing the efficiency of assembling the hubs 110, 120 with the elongate ribs 114. The hubs 110, 120 can be configured for enabling the efficient replacement of the ribs 114. Although the lower hub 120 is described herein in FIGS. 2-5, it is to be understood that the described features of the lower hub 120 can also or alternatively be used or provided with the upper hub 110 or with intermediate hubs (not shown).

The elongated ribs 114 can be pivotably attached to either of the upper hub 110 or the lower hub 120 on the elongate pole 111 to provide support for an umbrella canopy member, such as a canvas or other flexible member to span between the ribs 114 (not shown). The elongate pole 111 can comprise an upper end 111*a* and a lower end 111*b* with a body 111*c* extending along a longitudinal access extending therebetween. The upper hub 110 can be fixedly attached with the upper end 111*a* of the pole 111. The lower hub 120 can be disposed on the elongate pole 111 and slidingly engaged therewith between the upper end 111*a* and the lower end 111*b*.

FIG. 1 also shows that the umbrella assembly 100 can include a plurality of structural members, e.g., including elongate ribs 114. Each of the ribs 114 can have an inner end 114*a*, an outer end 114*b*, and a body 114*c* that extends along a longitudinal axis between the inner end 114*a* and the outer end 114*b*. The ribs 114 are discussed in more detail below in connection with FIG. 5.

Figure 2:
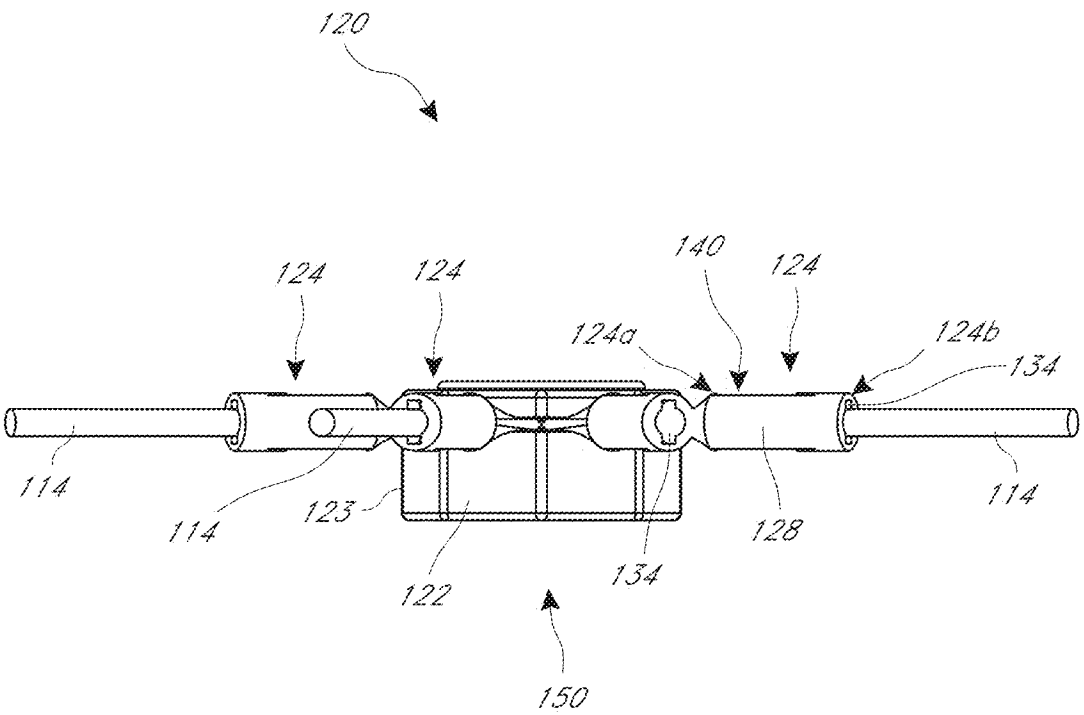
FIG. 2 is a side elevation view of the lower hub illustrated in FIG. 1, the lower hub having sockets.

FIG. 2 shows an enlarged view of the lower hub 120 and the ribs 114 in greater detail. As noted above, features of embodiments herein can be provided on the upper hub 110 or on intermediate hubs so the description will sometimes just refer to the hub 120. The hub 120 can include an arcuate portion, such as cylindrical portion 122, and a plurality of sockets 124. The sockets 124 can be configured such that the plurality of elongate ribs 114 can be inserted into the plurality of sockets 124. In various embodiments herein, the sockets 124 can be pivotable relative to the cylindrical portion 122. Optionally, the cylindrical portion 122 is configured to be disposed about the elongate pole 111. When so disposed, the cylindrical portion 122 can be affixed to or slidable along the pole 111. The cylindrical portion can have an interior profile and an exterior profile of any shape, including triangular, rectangular, square, cylindrical, or other shape profile.

In certain embodiments, the lower hub 120 can comprise a base material such as metal or plastic. Suitable plastics can include polyethylene terephthalate, high-density polyethylene, polyvinyl chloride, low-density polyethylene, polypropylene and polystyrene. In one embodiment, the base material of the hub 120 is a single type of material such as metal or plastic. In another embodiment, the entire structure of lower hub 120 including cylindrical portion 122 and sockets 124 can be made from a single material and/or can have a unitary structure.

Optionally, the socket 124 has a fixed end 124*a* coupled with the cylindrical portion 122 and a free end 124*b* disposed away from the fixed end 124*a*. Optionally, the socket has a cylindrical wall 128 extending from between the fixed end 124*a* and the free end 124*b* with the cylindrical wall 128 defining a concave space 148. Optionally, the concave space 148 extends from the free end 124*b* towards the fixed end 124*a*. In one embodiment, the socket 124 has an opening 134 configured to provide access to the concave space 148. Optionally, the opening 134 is on the free end 124*b*. Optionally, the opening 134 can be on a radially outward facing surface on the free end 124*b*. The opening 134 is discussed in further detail in connection with FIG. 6. In some embodiments, the free end 124*b* can be coupled with other sockets and/or the cylindrical portion 122.

In certain embodiments, the socket 124 includes an access aperture 140 that provides an access opening to the concave space 148. The access aperture 140 can extend through the cylindrical wall 128. In one embodiment, the access aperture 140 is disposed between the free end 124*b* and the fixed end 124*a*. Optionally, the access aperture 140 is a first access aperture and the socket 124 comprises a second access aperture 144. In one embodiment, the first and second access apertures 140, 144 are disposed on opposite sides of the socket 124. In another embodiment, the access aperture 140 is at a top or an upper location and/or the second access aperture 144 is at a bottom or lower location on the socket 124.

In certain embodiments, the sockets 124 are pivotable with respect to the cylindrical portion 122. As such both the free end 122*b* and the fixed end 122*a* can be moveable relative to the cylindrical portion 122. For example, an axle, a linkage or other mechanism can be provided to enable the socket 124 to move relative to the cylindrical portion 122. In certain embodiments, the socket 124 is coupled with the cylindrical portion 122 through a flexible region 132. Optionally, the flexible region 132 comprises a continuous and seamless expanse of the base material connecting the socket 124 to the cylindrical portion 122. Optionally, the flexible region 132 is provided by a locally thin expanse disposed between the cylindrical portion 122 and the fixed end 124*a* of the pivotable member 124. The flexible region 132 is further described in reference to FIGS. 3 and 4A-4B below.

Figure 3:
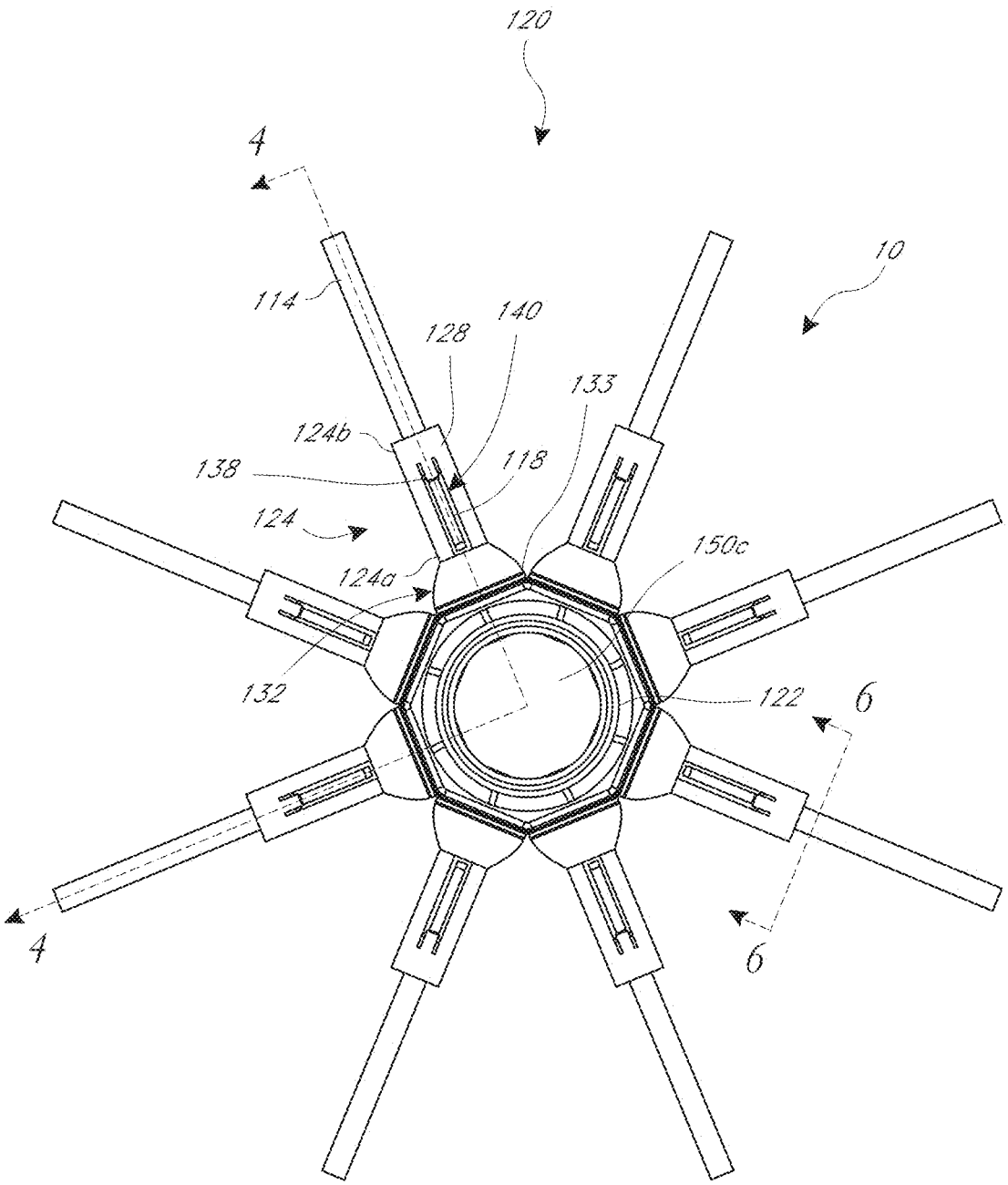
FIG. 3 is a top view of the lower hub illustrated in FIG. 2.

Referring to FIG. 3, in certain embodiments, hub 120 can have a central channel 150 that extends through the cylindrical portion 122. In the hub assembly, the plurality of sockets 124 and the plurality of elongate ribs 114 can be coupled together. Optionally, the plurality of sockets 124 extend from the cylindrical portion 122 of the hub 120 in a radial direction. The plurality of sockets 124 are optionally evenly spaced around the perimeter 123 of the cylindrical portion 122.

In certain embodiments, the flexible region 132 comprises the base material and is either narrower or the same width as the socket 124. Optionally, the flexible region 132 has a locally wide section 133 that is wider than the socket 124 in a direction within a plane that is transverse to the pole 111. This locally wide section increases the durability and/or increases the fatigue strength of the flexible region 132. Optionally, the locally wide section 133 is less wide than the socket 124 in the direction within the plane that is transverse to the pole 111.

Figure 4A:
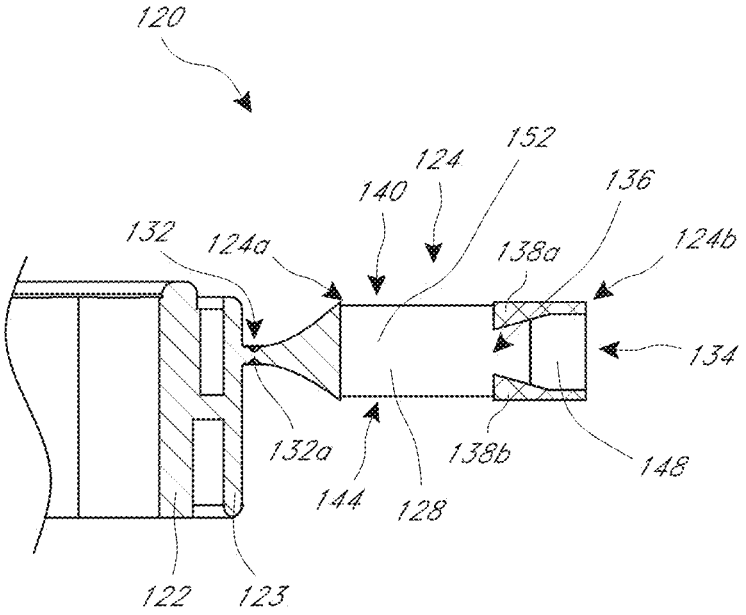
FIG. 4A is a partial section view of an umbrella hub having sockets taken along a portion of the section plane 4-4 in FIG. 3 having the elongate rib removed.

Referring now to FIG. 4A, the flexible region 132 optionally comprises a locally thin section 132a. The thinness of the thin section 132a optionally disposed in a direction transverse to the width of the locally wide section 133 or in a direction parallel to the pole 111. This locally thin section 132*a* can be sufficiently thin such that the base material of the flexible region 132 becomes more flexible than the base material surrounding the flexible region 132 and thereby socket 124 can be pivotable with respect to the cylindrical portion 122. Optionally, the locally thin section 132*a* comprises at least one indentation in a surface of the base material. Optionally, the flexible region comprises or is a portion of a living hinge.

In certain embodiments, the outer periphery 123 of the cylindrical portion 122 is coupled with the socket 124 by the flexible region 132. Optionally, the socket 124 comprises an opening 134 on the free end 124b that can provide access into a concave space 148 on the interior of the socket 124. The concave space 148 can comprise a narrow region 136 and a wider region 152. Optionally, the narrow region 136 is located between the free end 124*b* and the fixed end 124*a*. In one embodiment, the narrow region 136 is spaced away from opening 134 towards the fixed end 124*a*. In another embodiment, the narrow region 136 can be located between the wider region 152 and the free end 124*b*. In another embodiment, the wider region 152 is closer to the fixed end 124*a* than the narrow region 136 is to the fixed end 124*a*. The narrow region 136 can be disposed between the wider region 152 and a second wider region (not shown) disposed between the narrow region 136 and the free end 124*b*.

In certain embodiments, the narrow region 136 can be created by a flexible member 138. Optionally, the flexible member 138 comprises a first flexible member 138*a* and a second flexible member 138*b*. Optionally, the first flexible member 138*a* and/or the second flexible 138*b* member comprise a cantilever extending from the cylindrical wall 128. In certain embodiments, the first flexible number 138*a* is on an upper side of the socket 124 and the second flexible member 138*b* is on a lower side of socket 124 and create the narrow region 136. In another embodiment, the flexible member 138 extends from the cylindrical portion 128 into the concave space 148. First and second slits 139*a*, 139*b* can separate the flexible member 138 from the cylindrical portion 128 on least two sides. The first and second slits 139*a*, 139*b* can enable greater flexibility of the flexible member 138.

Figure 4B:
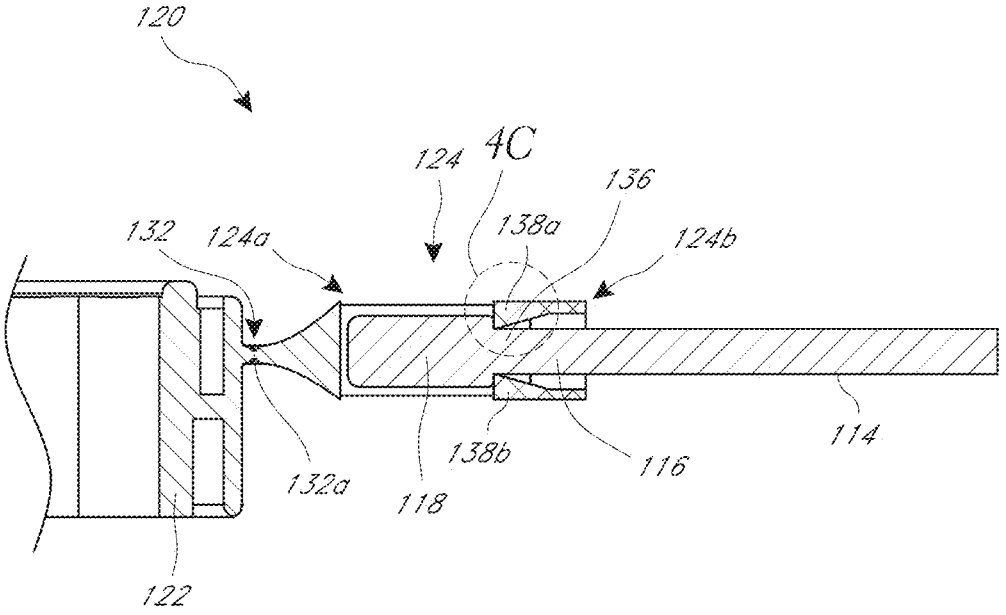
FIG. 4B is a section view of an umbrella hub having sockets taken along the line 4-4 in FIG. 3 having the elongate rib inserted.

Referring to FIG. 4B, in certain embodiments, the elongate rib 114 comprises a widened segment 118 and an adjacent segment 116 on inner end 114*a* of the elongate rib 114. Optionally, the widened segment 118 is inserted through the opening 134 into the concave space 148 and is secured in the space 148 by the flexible member 138*a* and/or the flexible member 138*b*. Optionally, the widened segment 118 is inserted into the free end of 124*b* of the socket 124 towards the fixed end 124*a* of the socket 124.

In certain embodiments, the narrow region 136 can be temporarily expanded by the widened segment 118 to provide access for the widened segment 118 to the wider region 152 of the concave portion 148. In such a configuration the elongate rib 114 can be securely fastened within the concave space 148 by the flexible member 138*a* and/or the flexible member 138*b*. In certain embodiments, the flexible members 138*a*, 138*b* comprises an elastic material. Optionally, the elastic material of the flexible members 138*a*, 138*b* can be elastically to accommodate the passage of the widened segment 118 of the elongate rib 114 past the narrow region 136 when the rib 114 is inserted into the concave space 148. Optionally, the wider region 152 of the concave space 148 is sized to accommodate the widened segment 118 of the elongate rib 114. Optionally, the deflectable members 138*a* and/or 138*b* can be configured to be deflected away from the narrow region 136 of the concave space 148 by advancing the elongate rib into the free end 124*b* and toward the fixed end 124*a*. Optionally, the deflectable members 138*a* and/or 138*b* can be configured to be deflected away from the narrow region 136 of the concave space 148 by advancing the elongate rib 114 into the free end 124*b* and toward the fixed end 124*a* and to return toward the center of the concave space 148 upon further advancement of the elongate rib 114 into the socket 124.

In certain embodiments, the access aperture 140 provide an access to the concave space 148, as discussed above. Optionally, the access aperture 140 can extend through the cylindrical wall 128. In one embodiment the access aperture 140 is at least partially aligned with the wider region 152 of the concave space 148. Optionally, the second access aperture 144 can be aligned with the wider region 152. In another embodiment, the access aperture 140 and/or the second access aperture 144 is aligned with the wider region 152. Optionally, the access apertures 140, 144 are aligned with the wider region 152 at a top location and a bottom location, respectively, on the socket 124. Each of the above configurations of the access apertures 140, 144 allows for easy access to the wider region 152 for convenient removal. The access aperture 140 can be rectangular or elongate in shape when viewed from above, an embodiment of which is shown in FIG. 2. The access aperture 140 can extend from a back wall 125 of the socket 124 to the flexible member(s) 138.

Figure 4C:
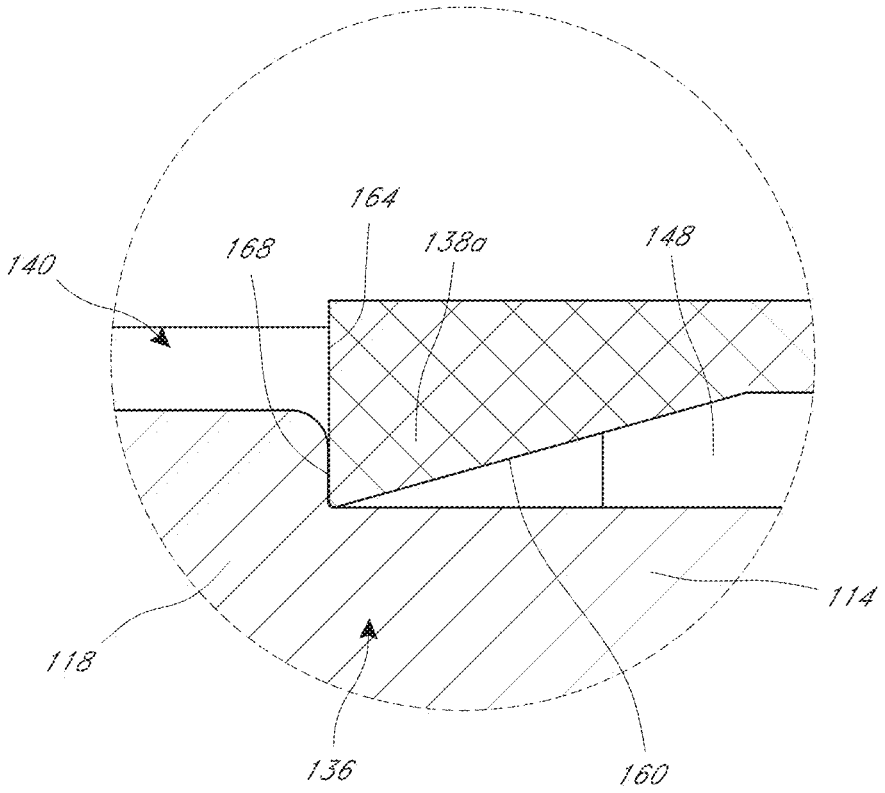
FIG. 4C is a detail view of FIG. 4B.

Referring to FIG. 4C, in some embodiments, the flexible member 138*a* comprises an inclined surface 160 and a catch surface 164. Optionally, the inclined surface is at an angle relative to a longitudinal axis of the socket 124. Optionally, the catch surface 164 is at a transverse angle to the inclined surface 160. The catch surface 164 can be disposed to face away from the inclined surface 160. The catch surface 164 can be configured to face the cylindrical portion 122. Optionally, when the widened segment 118 of the rib 114 is inserted into the concave space 148, the widened segment 118 slides along the inclined surface 160. Optionally, the widened segment 118 pushes the flexible member 138*a* outward and thereby widens the narrow region 136 sufficiently for the widened segment 118 to pass through to the wider region 152. Optionally, once the widened segment 118 is pushed past the narrow region 136, the flexible member 138*a* returns towards the longitudinal axis of the socket 124. Optionally, the catch surface engages with a stepped surface 168 of the widened segment 118 at an engagement angle after the widened segment 118 is fully through the narrow region 136 and/or the flexible member 138*a* returns towards the longitudinal axis of the socket 124. The stepped surface 168 can be on a radially exterior surface of the widened segment 116. The engagement of the catch surface 164 with the stepped surface 168 at the engagement angle can prevent the widened segment 118 of the rib 114 from being extracted from the concave space 148. The engagement angle can be perpendicular or substantially perpendicular to the longitudinal axis of the rib. The catch surface 164 can be parallel or substantially parallel to the stepped surface 168. Although the access apertures 140, 144 are optional if present, orienting the catch surface 164 and the stepped surface 168 along the direction from the aperture 140 to the aperture 144 facilitates simple ejection of the widened segment 118. Other angles can be provided where no ejection or other means of ejection of the widened segment is contemplated.

Figure 5:
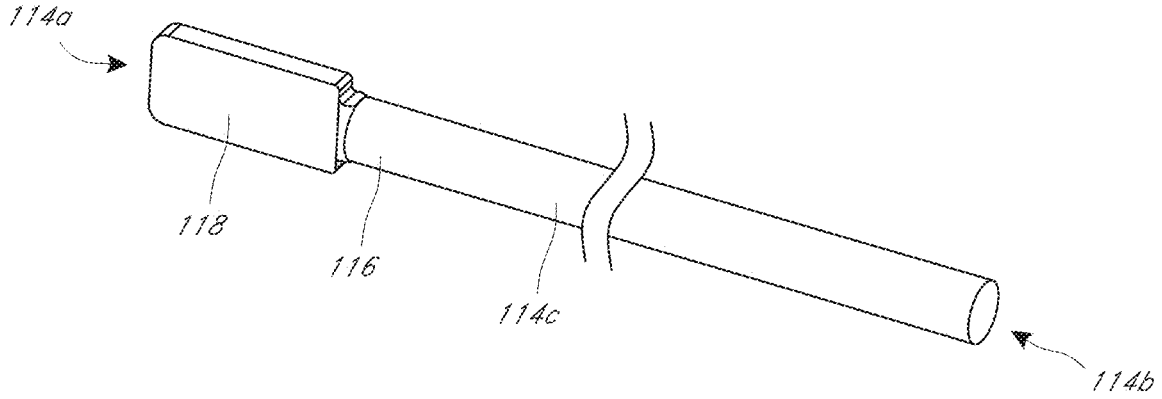
FIG. 5 is a perspective view of one embodiment of the elongate rib.

FIG. 5 shows that the inner end 114*a* of rib 114 can comprise the widened segment 118 and the adjacent segment 116. Optionally, the widened segment 118 comprises a segment that is wider in a first direction transverse to the longitudinal axis of the rib 114 than is the adjacent segment 116. Optionally, the adjacent segment is narrower than the widened segment 118 in at least one dimension. Optionally, the widened segment 118 comprises a low profile in a second direction transverse to the longitudinal axis of the rib 114. The second direction can be perpendicular to the first direction. The widened segment 118 can have a flattened portion in the second direction, the flattened portion can have an oblong, e.g., a rectangular cross section. Optionally, the adjacent segment 116 comprises a segment that has a round diameter having a circular or elliptical cross section.

The inner end 114*a* can also comprise the stepped surface 168 on the widened segment 118.

In certain embodiments, the elongate body 114*c* comprises a segment that has a round diameter having a circular or elliptical cross section. Optionally, the elongate body 114*c* and the adjacent segment 116 have the same profile. Optionally the elongate body 114*c* comprises a solid circular diameter that extends along the longitudinal axis of the rib 114 throughout the length of the elongate body 114*c*. Optionally, the adjacent segment 116 has a solid circular diameter that extends along the longitudinal axis of the rib 114 throughout the length of the adjacent segment 116.

Figure 6:
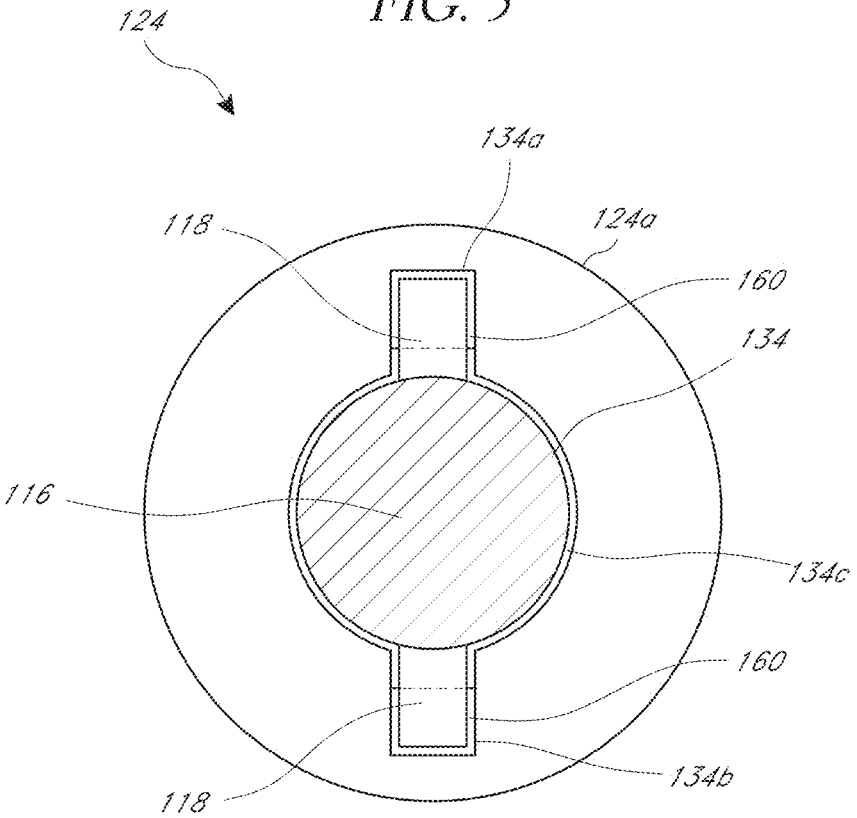
FIG. 6 is a cross-sectional view taken at section plane 6-6 in FIG. 3, the elongate rib only partially inserted into the socket and contacting an inclined surface shown in phantom lines.

Referring to FIG. 6, in certain embodiments, the opening 134 in the first end 124*a* of the socket 124 comprises a keyhole section 134*c*. Optionally, the opening 134 can also comprise a first wing section 134*a* and a second wing section 134*b* extending from the keyhole section 134*c*. In one embodiment, the first wing section 134*a* is disposed on an opposite side of the keyhole section 134*c* from the second wing section 134*b*. Optionally, the opening 134 can be configured such that the inner end 114*a* of the elongate rib 114 can be inserted into the concave space 148 of the socket 124. In one embodiment, the wing sections 134*a*, 134*b* can accommodate the widened segment 118 of the inner end 114*a*. In another embodiment, the adjacent segment 116 can be accommodated in the opening 134 by the keyhole section 134*c* of the opening 134. The wing sections 134*a*, 134*b* can align with the ramp portions 160 of the flexible members 138*a*, 138*b*. Optionally, the cross section of the adjacent segment 116 corresponds to the keyhole section 134*c*. Each of the features of the opening 134 is optional and many other configurations for the opening 134 also can be provided and the description should not be considered limiting in this regard.

Optionally, the narrow region 136 in the concave portion 148 created by the flexible members 138*a*, *b* is sized to accommodate the cross section or diameter of the adjacent segment 116 in a substantially undeflected state or configuration. Optionally, the flexible members 138*a*, *b* extend into the concave space 148 as far as the surface of the adjacent segment 116. Optionally, the flexible members 138*a*, *b* extend into the concave space 148 beyond the surface of the adjacent segment 116 and can thereby remain in contact with the surface 116 after the rib 114 is inserted into the socket 124. Optionally, the flexible members 138*a*, *b* extend into the concave space 148 beyond the widened segment 118 but not as far as the surface of the adjacent segment 116. Optionally, the widened segment 118 becomes trapped after being inserted into the socket 124 when an orthogonal surface of each of the members 138*a*, 138*b* abuts aa surface or surfaces of the widened segment 118 that extends between the inner end 114*a* and the adjacent segment 116. The abutting of these surfaces locates the surfaces of the flexible members 138*a*, 138*b* between the widened segment 118 and the adjacent segment 116, blocking the rib 114 from coming out of the concave space 148.

Figure 7A:
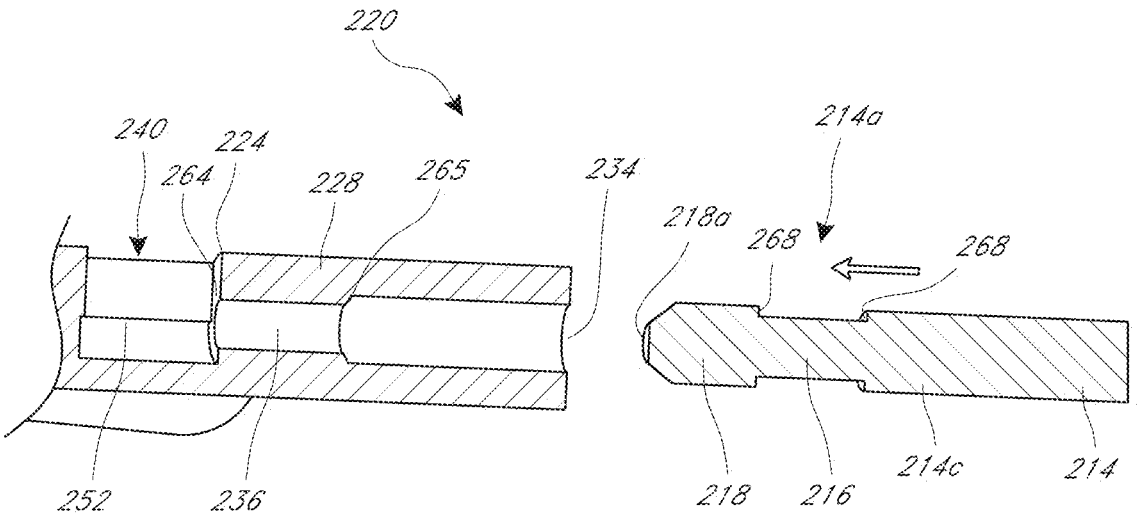
FIG. 7A is a section view of another embodiment of an umbrella hub having a socket, illustrating a method of connecting a rib to the umbrella hub.
Figure 7B:
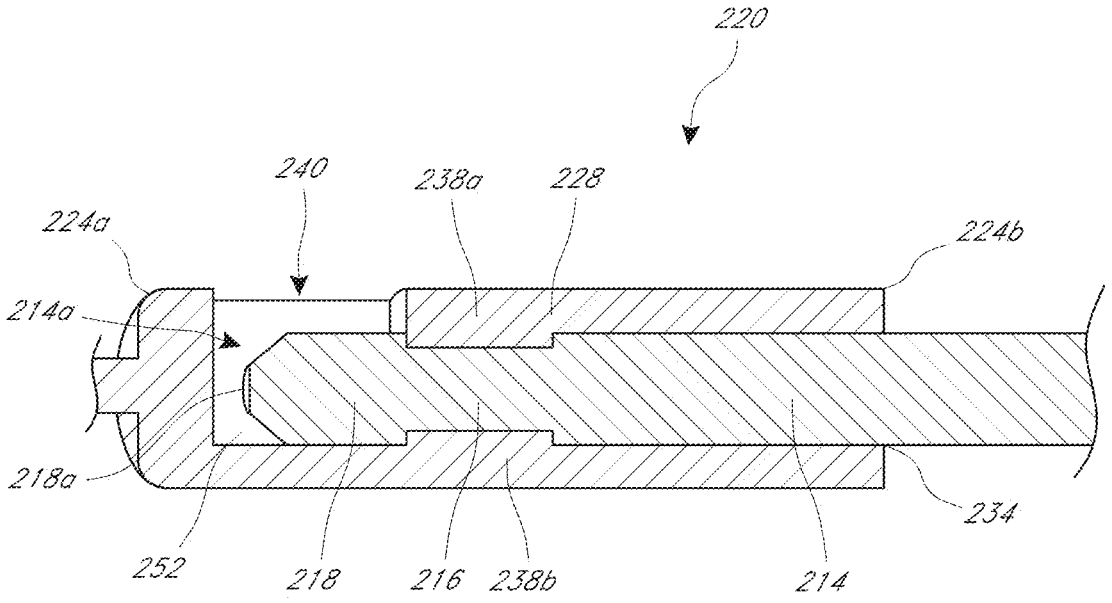
FIG. 7B is a section view of the umbrella hub in FIG. 6 showing an elongate rib inserted into the socket.

Referring to FIGS. 7A and 7B, in another embodiment of a hub 220, a socket 224 can comprise a free end 224*b* and a fixed end 224*a*. Optionally, the fixed end 224*a* is either pivotally coupled or pivotally fixed with respect to the cylindrical portion 222 (not shown) of the hub 220. Optionally, the socket 224 can further comprise a concave space 248. Optionally, the concave space 248 can comprise a wider region 252 and a narrow region 236. Access to the concave space 248 can optionally be through an opening 234. Optionally, the opening 234 is on the free end 224*b* of the socket 224. Optionally, the narrow region 236 is formed by an elastic portion of the cylindrical wall 228 that extends into the concave space 248. In other embodiments, the narrow region 236 is created by a pair of flexible members similar to the flexible members 138*a*, 138*b* as described above. The socket 224 can further comprise at least one access aperture 240. Optionally, the cylindrical wall includes a first catch surface 164 and a second catch surface 165 at opposite ends of the narrow region 236. The at least one access aperture 240 can extend through the cylindrical walls 228 into the concave space 248. In one embodiment, the at least one access aperture 240 provides access through the cylindrical wall 228 to the widened portion 252 of the concave space 248.

In some embodiments, the elongate rib 214 comprises an inner end 214*a* and an outer end 218*b* (not shown) and an elongate body 214*c*. First end 214*a* can comprise a widened portion 218 and an adjacent portion 216. In one embodiment, the widened portion 218 is wider than the adjacent portion 216 in at least one dimension transverse to a longitudinal axis of the elongate rib 214. Optionally, the first end 214*a* comprises a tapered or beveled segment 218*a*. The tapered or beveled segment 218*a* can aid in a process of inserting the inner end 214*a* of the elongate rib 214 into the socket 224. In some embodiments, the rib 114 comprises a first stepped surface 268 and a second stepped surface 269.

In certain embodiments, the elongate rib 214 is configured to be inserted into the socket 224 through the opening 234 in an inwardly radial direction. In one embodiment, the inner end 214*a* is inserted into the opening 234 and into the concave space 248. The inner end 214*a* can then be pushed through the narrow region 236 and the widened segment 218 can pass into the widened region 252 of the concave space 248. In one embodiment, the entire widened segment 218 passes into the widened region 252 of the concave space 248. In another embodiment, the adjacent segment 216 passes into the narrow region 236. In certain embodiments, when the inner end 214*a* is inserted into the narrow region 236, the widened segment 218 elastically deforms the elastic portion of the cylindrical wall 228 outward; as the widened segment 218 passes out of the narrow region 236, the elastic portion of the cylindrical wall returns inward. In another embodiment, the widened segment 218 of the elongate rib 214 flexes the flexible member and thereby sufficiently widens the narrow region 236 for the widened segment 218 to pass through. In some embodiments, when the widened segment 218 passes into the widened region 252, the first catch surface 264 engages with the first stepped surface 268. Optionally, the first catch surface 264 and the first stepped surface 268 can be opposing faces that are substantially perpendicular to a longitudinal axis of the rib 214. Thereby, the widened segment can be prevented from being removed from the widened region 252 in an outwardly radial direction. In some embodiments, when the adjacent segment 216 passes fully into the narrow region 236, the second catch surface 265 engages with the second stepped surface 269. Optionally, the second catch surface 265 and the second stepped surface 269 can be opposing faces that are substantially perpendicular to a longitudinal axis of the rib 214. Thereby, the adjacent segment 216 can be prevented from being pushed further into the socket 224 in an inwardly radial direction.

Figure 8A:
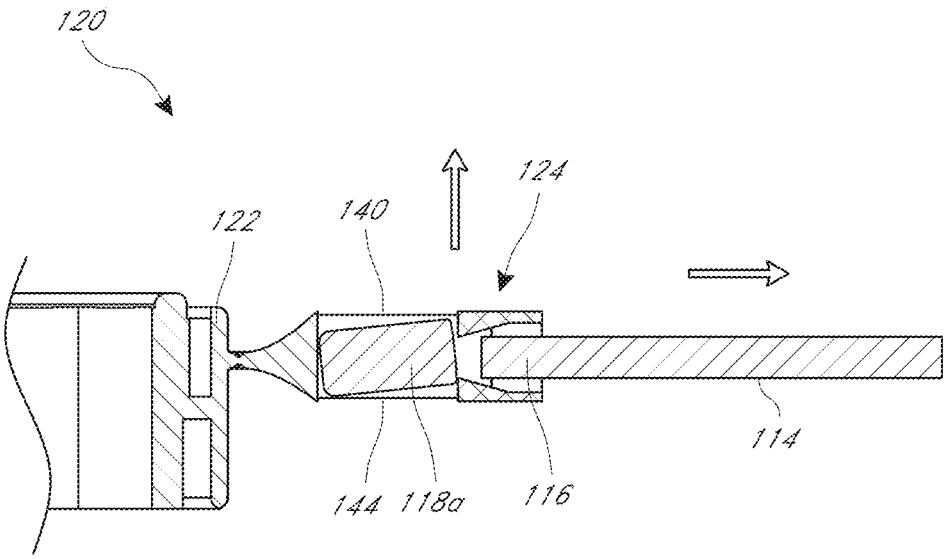
FIG. 8A is a section view of the umbrella hub of FIG. 4 illustrating the removal of a portion of an elongate rib that is broken at a junction between a widened segment and an adjacent segment.
Figure 8B:
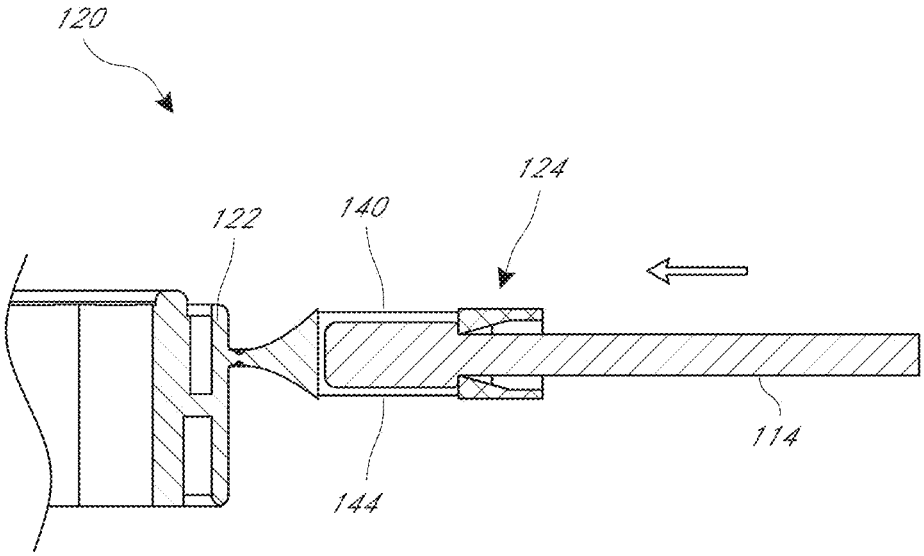
FIG. 8B is a section view of the umbrella hub of FIG. 4 illustrating the insertion of an elongate rib after the removal of the broken rib as illustrated in FIG. 8A.

Referring to FIGS. 8A and 8B, according to certain methods, an elongate rib 114 is inserted into the socket 124 and afterwards there is an occasion or reason to remove the elongate rib from the socket 124. Such an occasion or reason can include such as when the elongate rib 114 is broken or it otherwise becomes necessary for the remaining portion of the elongate rib 114 to be removed from the concave space 148. In such an instance, the access aperture 140 can be used within a method for removing the elongate rib 114. According to one method of replacing an umbrella rib, the method comprises accessing the inner end 114*a* of the umbrella rib 114 through the access aperture 140, severing the inner end 114*a* of the umbrella rib 114 from the elongate body 114*c*, ejecting the a severed end 118*a* of the umbrella rib 114 from the socket 124 through the access aperture 140, and removing the elongate body 114*c* from the concave space 148 through the free end 124*b* of the socket 124. Optionally, a cutting instrument can be used to sever the widened segment 118 from the adjacent segment 116 through the access aperture 140 or the second access aperture 144.

Optionally, once the widened segment 118 is severed to form the severed end 118*a*, the elongate rib 114 is removed from the concave space 148. Once the previous elongate rib 114 is removed, a new elongate rib 114 can be inserted into the socket 124 in the same manner as the original elongate rib was inserted. Thus the access aperture 140 provides additional benefit of providing an efficient means for replacing individual elongate ribs.

In another method, the rib 114 can be inserted into the socket 134. Optionally, the method comprises any combination or subcombinations of the following: aligning the widened segment 118 of the inner end 114*a* of the elongate rib 114 with the opening 134 of the socket 124, inserting the inner end 114*a* into the concave space 148, contacting the flexible member 138 with the widened segment 118, actuating the flexible member 138 through elastic deformation, widening the narrow region 136, inserting the inner end 114 of the elongate rib 114 inner end 114 of the elongate rib 114, inserting the widened segment 118 into the wider region 152, aligning the widened segment with the access aperture 140, and trapping the widened segment 118 in the wider region by allowing the flexible member 138 to return to form the narrow region 136 and thereby blocking the removal of the widened segment 118.

What is claimed is:

1. A shade assembly comprising:

a movable hub comprising:

an outer portion; and a socket having an inner end pivotably coupled to the outer portion and a free end disposed away from the outer portion, the free end including an opening comprising a central portion and a non-circular wing section connected with the central portion extending towards an outer circumference of the free end;

a rib coupled with the socket, the rib having an end configured to fit within the opening in a pre-defined rotational orientation with respect to the socket; and wherein the end is configured to be trapped within respective socket.

2. The assembly of claim 1, wherein the end of the rib includes a flattened region and the wing section is configured to receive the flattened region.

3. The assembly of claim 2, wherein the opening includes two wing sections on opposite sides of the central portion.

4. The assembly of claim 2, wherein the central portion has a diameter and the flattened region has a width greater than the diameter of the central portion.

5. The assembly of claim 4, wherein the socket includes an internal space and a catch, the catch configured to trap the flattened region of the end when the end of the rib is inserted into the socket through the opening.

6. The assembly of claim 5, wherein the catch in the socket includes an upper catch and a lower catch that engage on opposite sides of the flattened region of the end of the rib.

7. A shade assembly comprising:

a hub comprising:

an outer portion disposed about a central aperture; and a socket pivotably coupled to the outer portion and having an end disposed away from the outer portion, the end including an opening into the socket;

a rib having a rib end and a shaft, the rib end including a widened segment that is wider than a width of a body of the shaft, the widened segment including a stepped surface extending transverse to a length of the body of the shaft;

wherein the socket includes a catch configured to prevent the rib end from being removed when disposed within the socket through the opening by blocking the stepped surface.

8. The assembly of claim 7, wherein the body of the shaft includes a continuously outwardly curved outer surface adjacent to the stepped surface.

9. The assembly of claim 7, wherein the widened segment comprises a flat portion.

10. The assembly of claim 7, wherein the socket includes an access aperture disposed through an outer wall of the socket, the widened segment accessible through the access aperture when received within the socket.

11. The assembly of claim 7, wherein the socket includes a narrow internal space located between the end and the outer portion of the hub, the catch located at the narrow internal space, the catch located at the narrow internal space, a widened internal space located between the narrow internal space and the outer portion of the hub, the widened internal space configured to receive the widened segment of the rib.

12. The assembly of claim 11, wherein the catch comprises deflectable portions disposed on opposed sides of the socket configured to be deflected away from a centerline of the socket by advancement of the widened segment into the narrow internal space.

13. A shade structure assembly comprising:

a rib coupler comprising:

an arcuate portion disposed around an aperture, the aperture extending along an axis;

a plurality of sockets coupled with the arcuate portion; and a socket of the plurality of sockets configured to receive and trap a rib, the socket coupled to the arcuate portion, the socket having a first end, a second end disposed away from the first end, an outer wall disposed between the first end and the second end, and an opening on the second end;

wherein the first end of the at least one socket includes a pivotal connection provided by a flexible region, the flexible region including a living hinge including a locally thin section, the locally thin section having a width greater than a width of the socket within a plane transverse to the axis;

wherein a width of the flexible region within the plane tapers down from the width of the locally thin section to the width of the socket at the first end of the socket.

14. The assembly of claim 13, wherein the at least one socket and the arcuate portion are formed of a unitary expanse of material.

15. The assembly of claim 13, wherein the flexible region is thinner at an interface with the arcuate portion and thicker at an interface with the socket.

16. The assembly of claim 15, wherein an upper side of the flexible region includes a concave curvature and a lower side of the flexible region includes a concave curvature.

17. The assembly of claim 13, wherein the flexible region is wider than the width of the socket measured within a plane extending through the socket.

18. The assembly of claim 13, wherein the opening is keyhole-shaped and configured to trap a rib that includes an enlarged end.

* * * * *